US005620127A

United States Patent [19]

MacKenzie

[11] Patent Number: 5,620,127

[45] Date of Patent: Apr. 15, 1997

[54] FOLDABLE GARMENT CARRIER

[76] Inventor: Robert MacKenzie, 4781 N. Congress Ave., #145, Lantana, Fla. 33462

[21] Appl. No.: 441,689

[22] Filed: May 15, 1995

[51] Int. Cl.[6] ..... B60R 7/00; B60R 7/10; B60R 9/00; B60R 11/00

[52] U.S. Cl. ..... 224/555; 224/560; 224/563; 224/572; 224/927; 224/249; 223/89; 223/94; 248/304; 248/308

[58] Field of Search ..... 224/555, 560, 224/927, 249, 148, 219, 572, 563; 248/304, 308, 339, 208; 223/88, 89, 94

[56] References Cited

U.S. PATENT DOCUMENTS

| | | | |
|---|---|---|---|
| D. 256,405 | 8/1980 | Wheeler | D3/30 |
| D. 259,238 | 5/1981 | Schenck, III | D8/307 |
| D. 285,391 | 9/1986 | Mills | D6/328 |
| D. 307,359 | 4/1990 | White | D6/323 |
| D. 307,360 | 4/1990 | McAllister | D6/318 |
| 2,615,602 | 4/1952 | Thompson et al. | 223/88 |
| 2,781,959 | 2/1957 | Loveland | 224/148 |
| 3,554,417 | 1/1971 | Yorty | 224/45 |
| 3,578,226 | 5/1971 | Good | 224/45 |
| 3,633,801 | 1/1972 | Bonasso | 224/45 T |
| 3,705,674 | 12/1972 | Fisher | 224/45 T |
| 3,759,430 | 9/1973 | Ward | 224/45 T |
| 3,799,416 | 3/1974 | Schmaltz | 248/339 |
| 3,804,310 | 4/1974 | Wheeler | 248/308 |
| 3,885,723 | 5/1975 | Magnie | 224/45 T |
| 4,045,067 | 8/1977 | Wieder et al. | 294/15 |
| 4,153,189 | 5/1979 | Hughes | 224/560 |
| 4,238,062 | 12/1980 | Wheeler | 224/45 T |
| 4,266,705 | 5/1981 | Wheeler | 294/163 |
| 4,284,219 | 8/1981 | Standel, Jr. | 294/152 |
| 4,557,516 | 12/1985 | Usner | 223/88 |
| 4,664,267 | 5/1987 | Clark | 211/94 |
| 4,709,954 | 12/1987 | Beyda et al. | 294/142 |
| 4,720,028 | 1/1988 | Takemura et al. | 224/42.45 A |
| 4,730,863 | 3/1988 | Guadnola | 294/156 |
| 4,763,820 | 8/1988 | Gardner, Jr. | 224/42.46 A |
| 5,104,083 | 4/1992 | Shannon | 248/339 |
| 5,306,063 | 4/1994 | Higgins et al. | 294/143 |
| 5,328,068 | 7/1994 | Shannon | 224/42.46 A |
| 5,330,244 | 7/1994 | Rodwell | 224/927 |

*Primary Examiner*—David J. Walczak
*Assistant Examiner*—Timothy L. Maust
*Attorney, Agent, or Firm*—John C. Smith

[57] ABSTRACT

A portable garment carrier with a handle portion and a garment holder portion which are connected by a central hook attachment that attaches to the garment hook on the interior of a vehicle. The handle portion folds down over the central hook attachment when it is suspended from a car hook. The garment carrier is fabricated from flexible material. The garment carrier can also be made from rigid material with a hinge mechanism to allow the handle portion to fold during use or for more convenient storage. An optional gap in the handle allows the handle to be suspended from a closet clothing rack. Alternate embodiments allow written information such as advertising messages to be displayed on the central hook attachment, folding handle grips which provide more comfortable handling, and specialized handles which can also be used to suspend the garments in a closets. The device may be fabricated as a disposable or reusable unit.

7 Claims, 8 Drawing Sheets

FOLDABLE GARMENT CARRIER

BACKGROUND OF THE INVENTION

1. Technical Field

This invention relates to garment carriers. In particular, it relates to foldable garment carriers which are designed to attach to automobile garment hooks.

2. Background Art

To avoid unnecessary extra trips, many individuals deposit several garments with dry cleaners or launderers at each visit to the cleaning establishment. An inconvenience caused by depositing multiple garments is related to the custom of placing each garment on a separate clothing hanger. As the number of clothing hangers increases, it becomes more and more inconvenient to carry the clothing hangers with one hand.

Prior art attempts to address this problem have centered on devices which provide a handle attached to a hanger holder to relieve problems associated with directly holding the clothing hangers. Other attempts have used clamping devices, removable hanger bars, over the shoulder straps to provide a more comfortable method of carrying garments, specialized garments bags, etc.

In addition to the inconvenience associated with handling multiple garments, there is another problem associated with the transport of garment hangers. Namely, how does the user attach the garment hangers to the inside of the automobile while driving? The garment hook normally found inside of an automobile is typically small and does not always have sufficient capacity to hold all of a user's garment hangers. In addition, the garment hangers often damage the inside of the automobile and/or the garment hook.

Some automobile manufacturers have incorporated retractable garment hooks on the inside of the vehicle which provide additional storage capacity. However, these are not usable for carrying the garments to the vehicle, and further, they are only available on a limited number of vehicles that have the devices preinstalled.

Another problem associated with prior art devices is how the garments are stored once they are returned to the dwelling. Known devices which have the capacity to hang directly from closet hanger bars are not capable of hanging on garment hooks in automobiles.

It would be desirable if a single device could comfortably fit the users hand while carried, provide expanded capacity for garment hangers, not damage the inside of the automobile, provide convenient storage once returned to the user's closet, and be capable of folding for convenient storage.

SUMMARY OF THE INVENTION

The foregoing problems have been overcome by a portable garment carrier which provides an upper handle that has a comfortable gripping area for a users hand, a lower holder which has the capacity to hold substantially more clothing hangers than an automobile garment hook can, and a hook attachment which allows the device to be attached to the garment hook in the automobile without damaging the interior of the vehicle. An alternative embodiment provides a rigid handle which has a gap that allows the handle to be hung from a standard closet hanger bar. A second embodiment provides a hinged handle that can be folded over the lower holder to provide more compact and convenient storage. A third alternative embodiment provides an expanded surface area between the hook attachment and the handle which can be used for a variety of indicia such as advertising. A fourth embodiment provides a flexible handle extension which folds to provide a more comfortable gripping area.

DESCRIPTION OF THE PREFERRED EMBODIMENT

Figure 1:
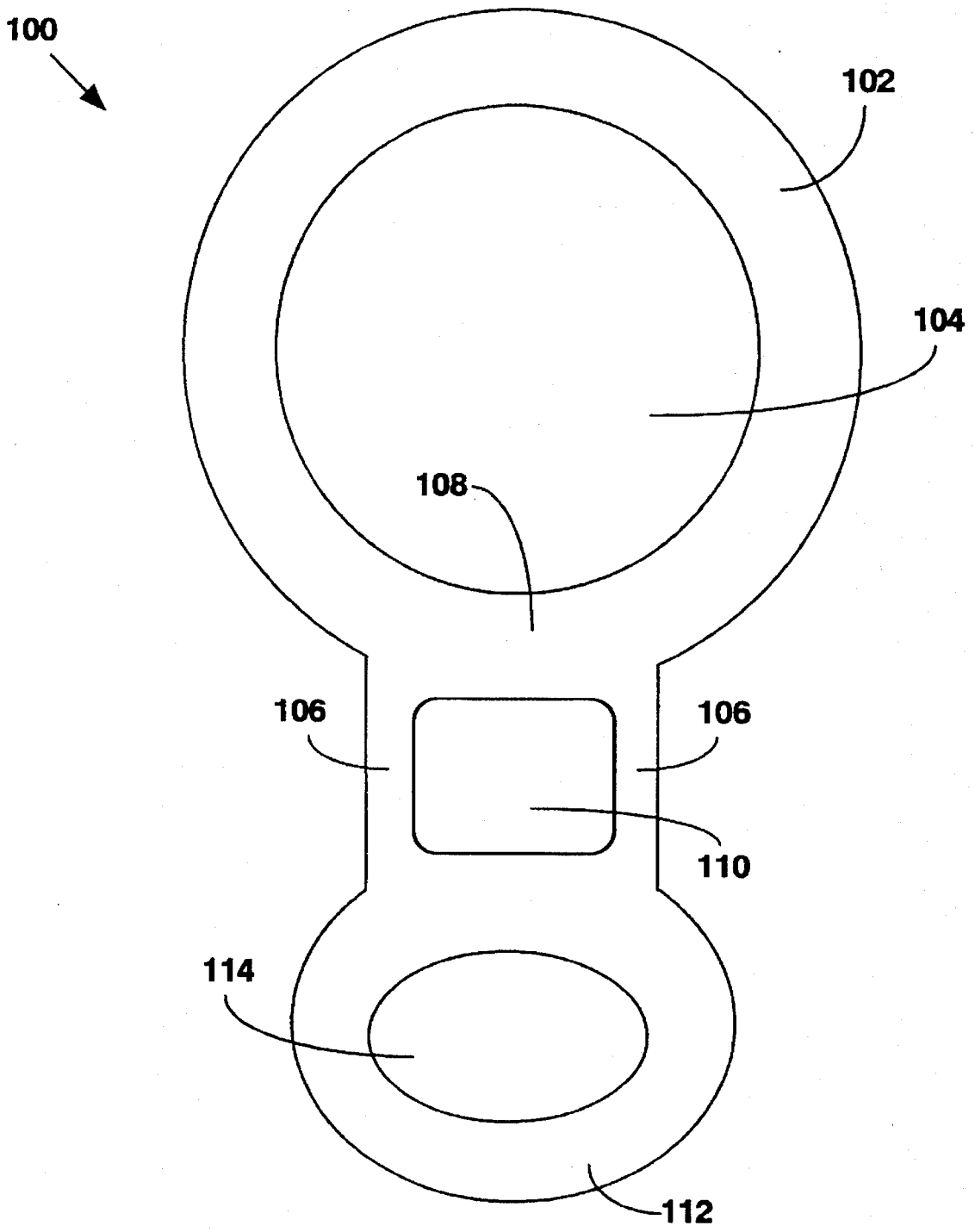
FIG. 1 illustrates a preferred embodiment which is fabricated from a single sheet of flexible material.

FIG. 1 illustrates a preferred embodiment of the garment carrier 100 in which the device is fabricated from a single sheet of flexible material. In the preferred embodiment, the flexible material is stamped from sheets of 40 mil low density polyethylene. However, those skilled in the art recognize that any number of other thicknesses and/or materials can be substituted so long as they are flexible and have sufficient strength to hold the weight of the clothing hangers intended to be carried.

A handle assembly 102 is shown at the upper end of the device. The handle assembly encircles a handle aperture 104 which is sized to comfortably accept a users hand. In the preferred embodiment, the handle aperture 104 size is between 3 and 4 inches. However, the size is not critical and can vary to suit a particular design so long as the user's hand can comfortably grasp handle assembly 102. Likewise, the handle assembly 102 has a diameter of approximately one half inch. As was the case with the handle aperture 104 size, the precise dimension of the handle assembly 102 is not critical. The only requirements being that the user can comfortably hold and that the device can support the weight of the garments it carries. At the lower end of the garment holder 100 is a holder assembly 112 which has an aperture 114. During use, the hooks of a number of clothing hangers (not shown) are suspended from the holder assembly 112.

The handle assembly 102 and the holder assembly 112 are each attached to a hook attachment 106, 108 which is comprised of side extensions 106, and central portion 108. In the preferred embodiment, side extensions 106 are 0.35 inches wide. As was the case above, dimensions are not critical so long as strength requirements are maintained. Central portion 108 forms the lower part of the loop formed by handle assembly 102 in the preferred embodiment, but can alternatively be a separate extension which extends below the loop formed by handle assembly 102. Side extensions 106, central portion 108, and holder assembly 112 form hook aperture 110. In the preferred embodiment, hook aperture 110 is 0.65 inches wide and 0.91 inches wide.

Again, the aperture size is not critical with the exception that the hook aperture 110 must be sufficiently large to fit over an automobile garment hook.

Hanger assembly 112 is attached to hook attachment 106, 108. In the preferred embodiment, hanger assembly 112 has a diameter of approximately one half inch, but the dimensions may vary. Likewise, hanger aperture 114 is sized between 1 and 2 inches. As was the case with the previous dimensions, the size is not critical and can vary to suit a particular designer's needs.

FIG. 1 illustrates the device as having generally circular loops for the handle assembly 102 and the hanger assembly 112. However, those skilled in the art will recognize that shape is not important and may vary to suit ornamental needs so long as each component performs its respective function. Like wise, the hook attachment 106, 108 is located in the central portion of the device between handle assembly 102 and hanger assembly 112 to avoid interfering with the user's hand while carrying the device.

During normal use, the user places clothing hangers onto holder assembly 112 by inserting the hooks of the clothing hangers (not shown) through aperture 114. The user then carries the garment carrier 100 by holding handle assembly 102. When the user places garment carrier 100 in an automobile, the handle assembly 102 is flexed away from the interior of the vehicle. As a result, the central portion 108 of hook attachment 106, 108 can be conveniently mounted onto the garment hook (not shown) of the automobile. Due to the flexible nature of the device, and the hook attachment 106, 108, the garment carrier 100 allows more clothing hangers to be suspended from the vehicle's garment hook than could be suspended directly from the garment hook. In addition, hook attachment 106, 108 provides the additional advantage of keeping the suspended garment hangers at a distance from the vehicle's garment hook and interior, thereby avoiding damage to the interior of the vehicle.

Figure 2:
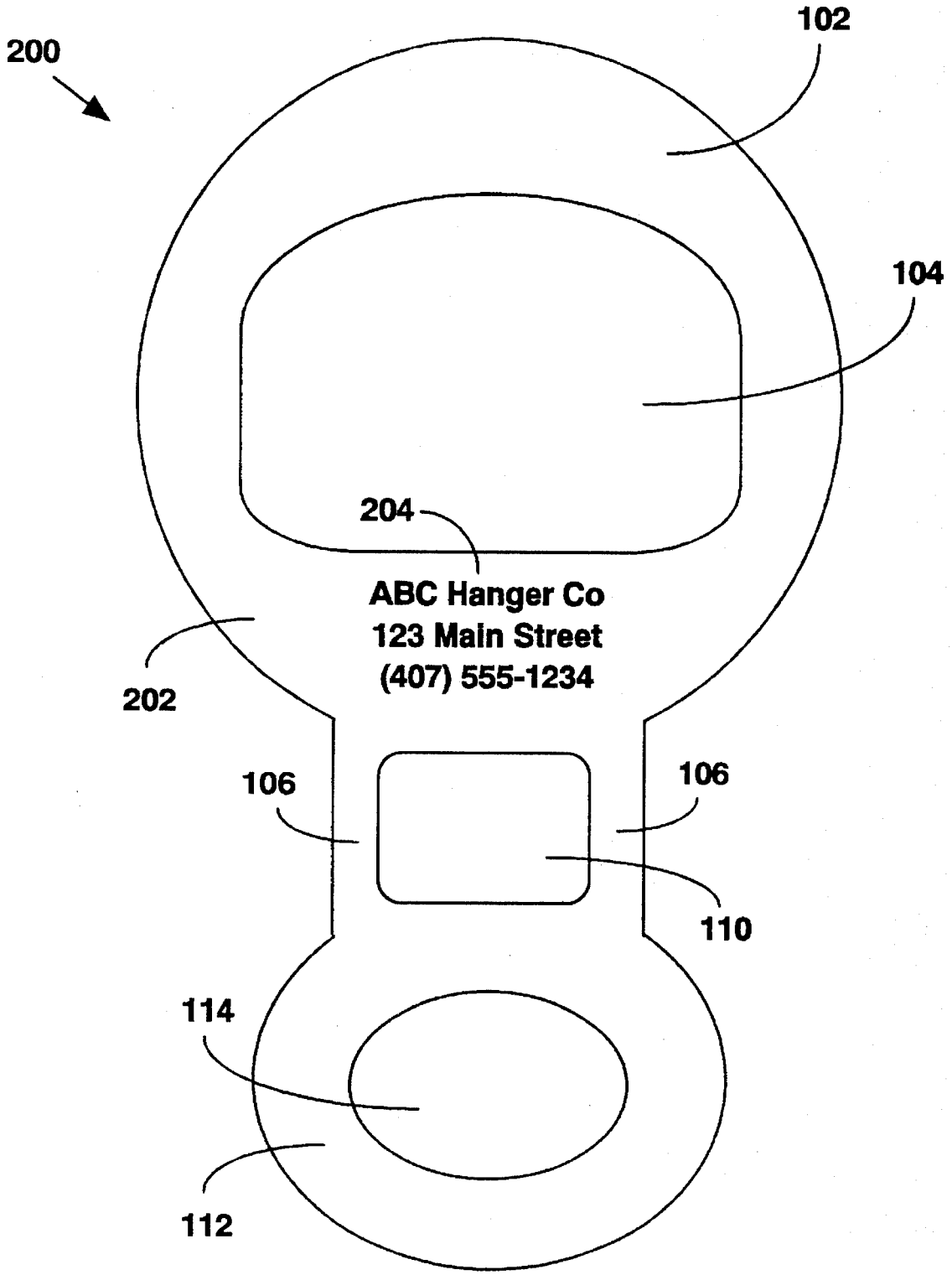
FIG. 2 illustrates an alternative embodiment which provides a flat surface area on the hook attachment for indicia such as advertising.

In FIG. 2, an alternative embodiment of the garment carrier 200 is shown which extends the area in central portion 202 of hook attachment 106, 202. By providing the extended surface area, any desirable information may be printed on the surface of the device. Advertising, decorative images, etc. may be used by applying the appropriate indicia 204. Handle assembly 102 can also be shaped in any convenient manner to provide a comfortable grip for the user. As was the case with the embodiment of FIG. 1, this embodiment is fabricated from flexible material and used in the same manner as the embodiment of FIG. 1.

Figure 3A:
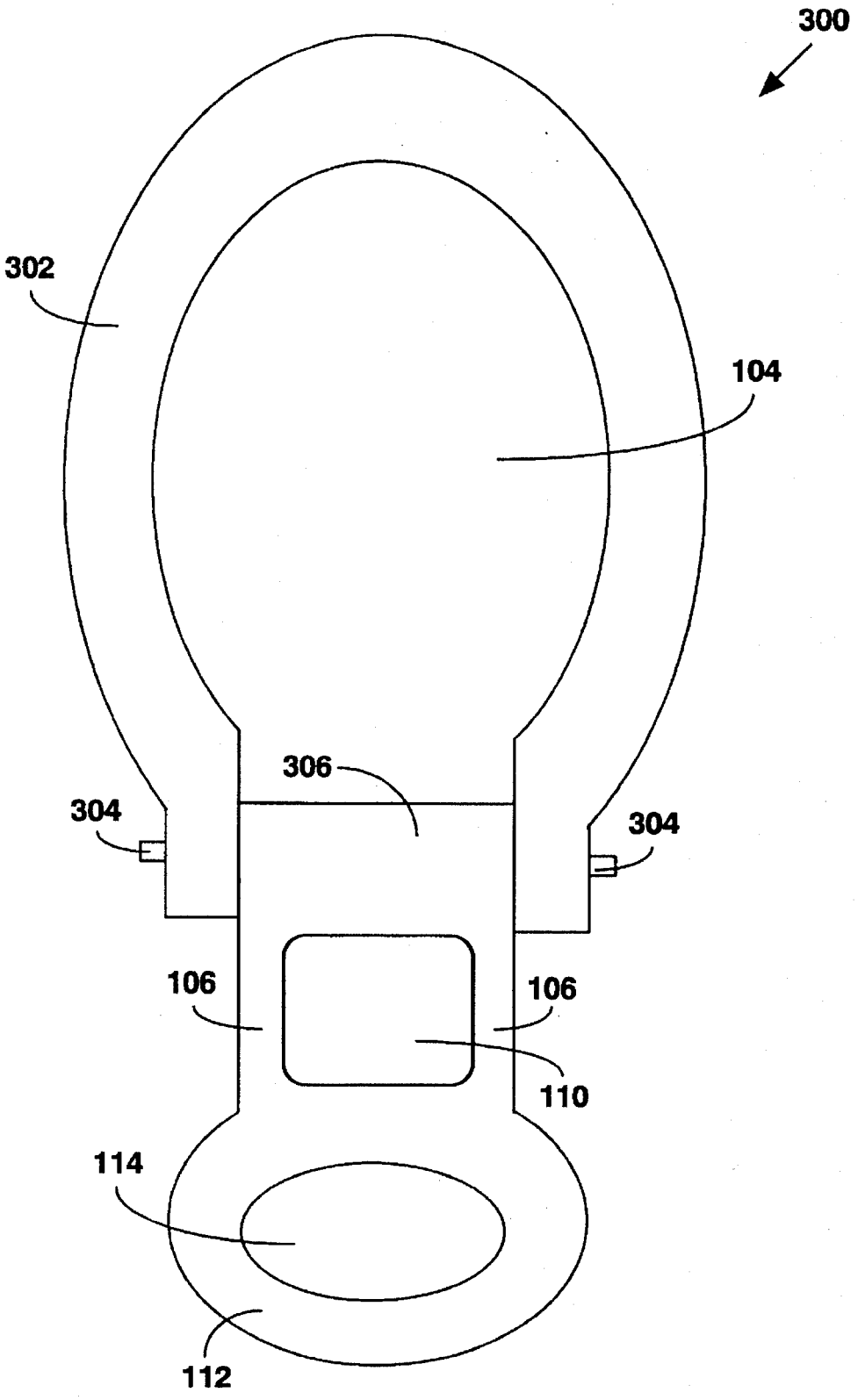
FIGS. 3A and 3B illustrate another alternative embodiment which attaches the handle assembly to the hook attachment with a hinge such that it can fold for storage.

Regarding FIG. 3A, this embodiment is similar to the embodiments shown in FIGS. 1 and 2. A principle difference is that garment carrier 300 uses a hinge 304 to attach handle assembly 302 to hook attachment 106, 306. This embodiment can be made from flexible or rigid material. Further, the handle can be formed in any desirable shape such as straight edged, with finger grips, flat, cushioned etc. Due to the hinge 304, which allows handle assembly 302 to be rotated away from the interior of the vehicle, the handle assembly can be made from a wider variety of materials and does not have to be made from the same material as hook attachment 106, 306 or holder assembly 112. Central portion 306 must be thick enough to accommodate hinge 304.

While the previous embodiments would be economically manufactured by stamping from a single sheet of material, the hinged structure of this device lends itself more to a reusable device of heavier construction strength. Handle assembly 302 can be fabricated from metal, wood, plastics, polyethylene, polypropylene or any other suitable material. However, central portion 306 is preferably made from flexible material to allow flexing while inserting the automobile's garment hook through aperture 110.

Figure 3B:
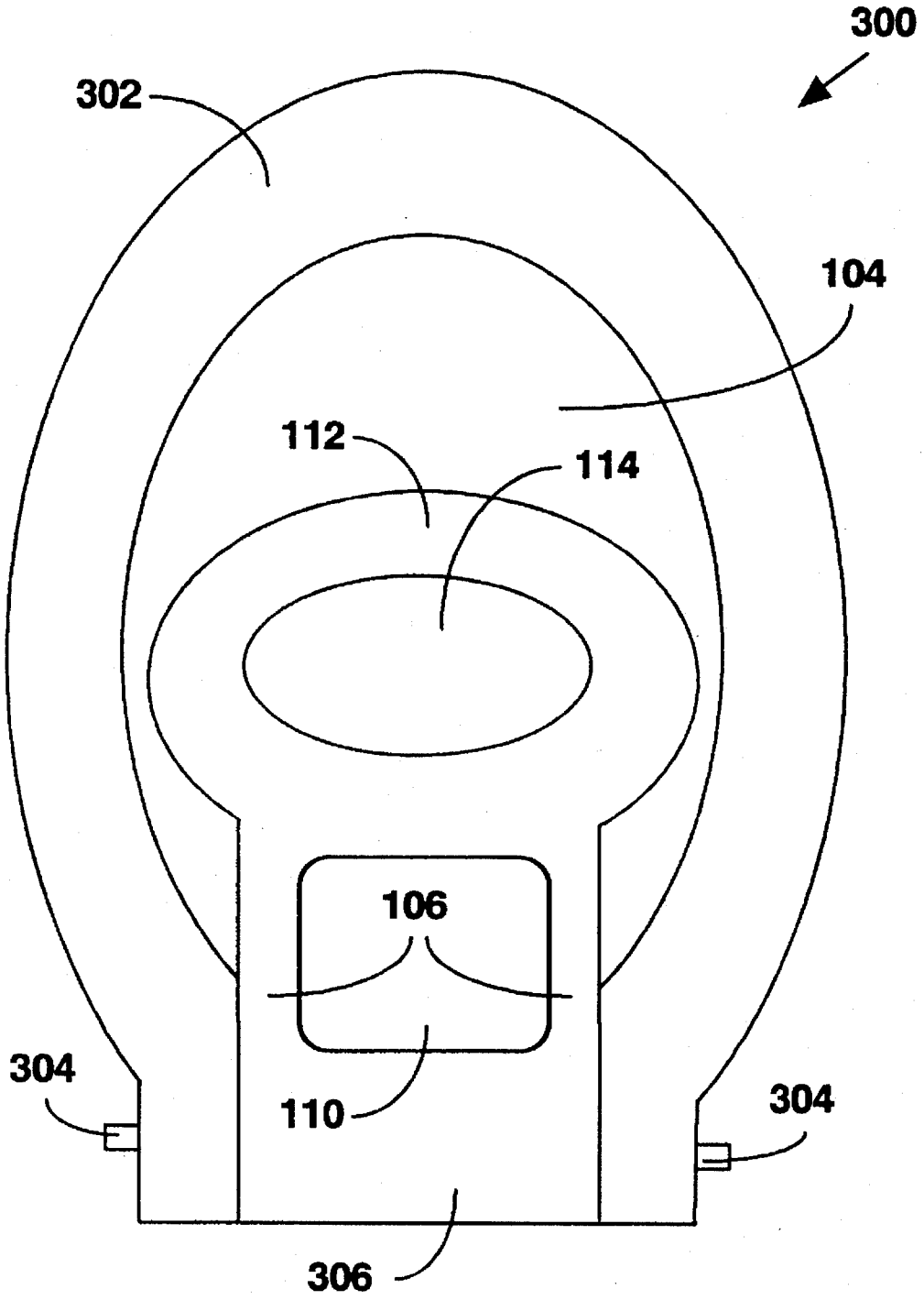

FIG. 3B is a folded view of the embodiment of FIG. 3A. This view illustrates another advantage of the hinge assembly 304 which allows the hook attachment 106, 306 and holder assembly 112 to fold into the aperture 104 of handle assembly 302. This allows the device to be more conveniently stored. For example, in the glove compartment of an automobile. The hinge 304 can be fabricated from any number of suitable hinge mechanisms, all well known in the art.

Figure 4A:
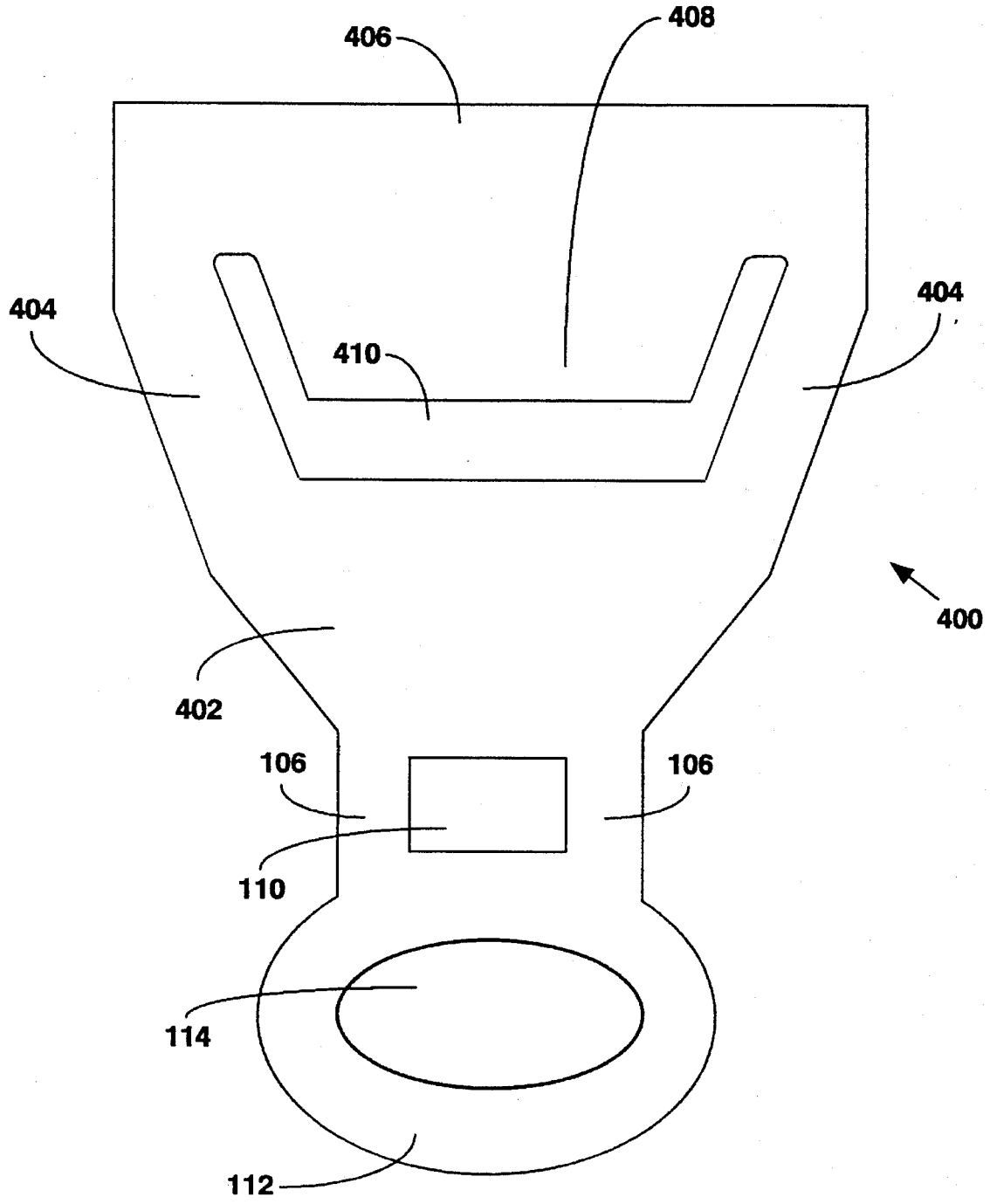
FIGS. 4A, 4B and 4C illustrate another alternative embodiment, similar to the embodiments of FIGS. 1 and 2, which includes a foldable extension on the handle assembly that folds to form a flap which acts as a more comfortable handle grip.

FIG. 4A shows another alternative embodiment. In this embodiment, the device is fabricated by stamping a single sheet of material. The same material, 40 mil low density polyethylene, was found to perform satisfactorily in the preferred embodiment. While maintaining the centrally located hook attachment 106, 402, hook aperture 110, and hanger assembly 112 found in all the other embodiments, this embodiment provides an alternative handle assembly which includes first and second arms 404 and central grip 406 with an extension 408.

Figure 4B:
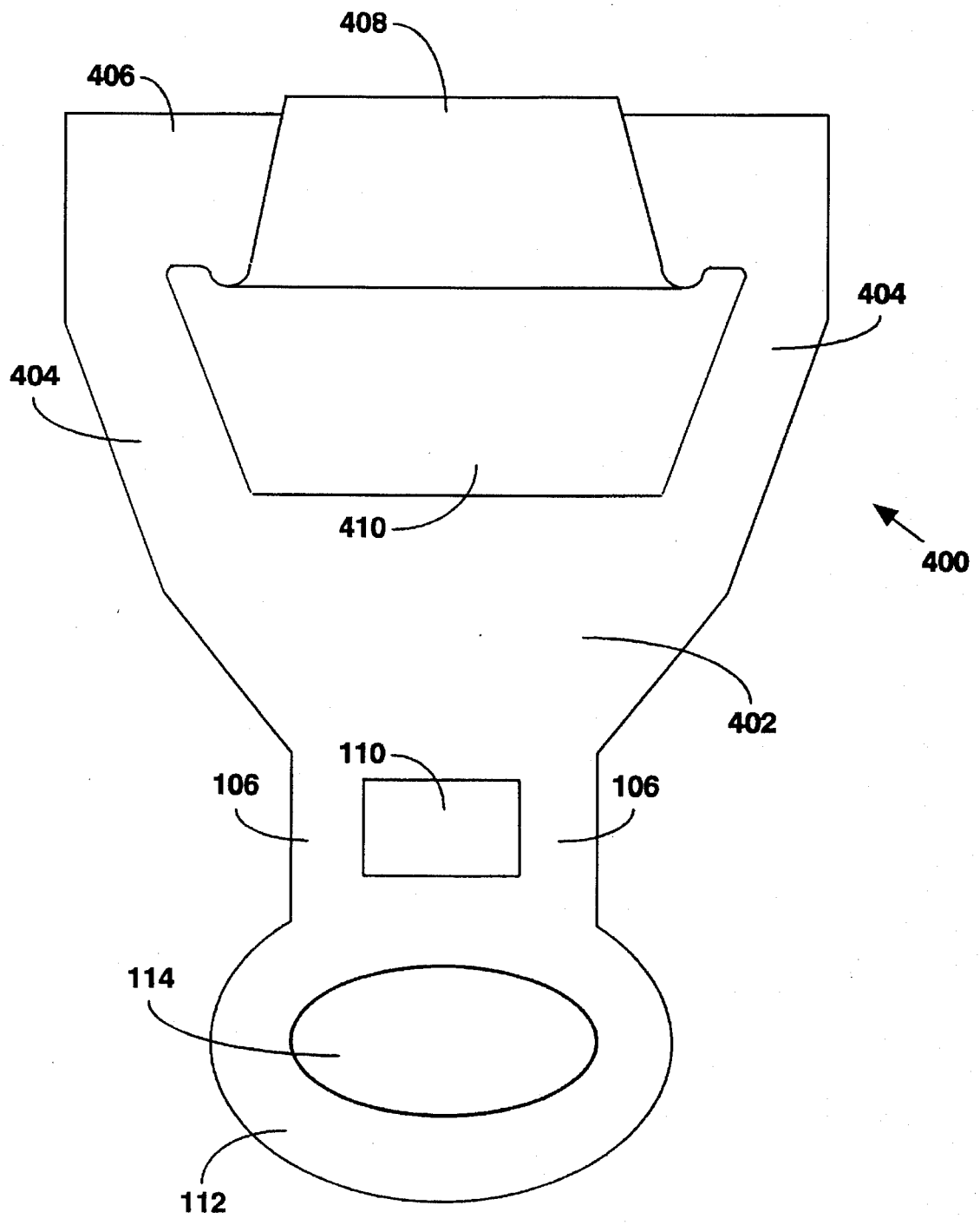
Figure 4C:
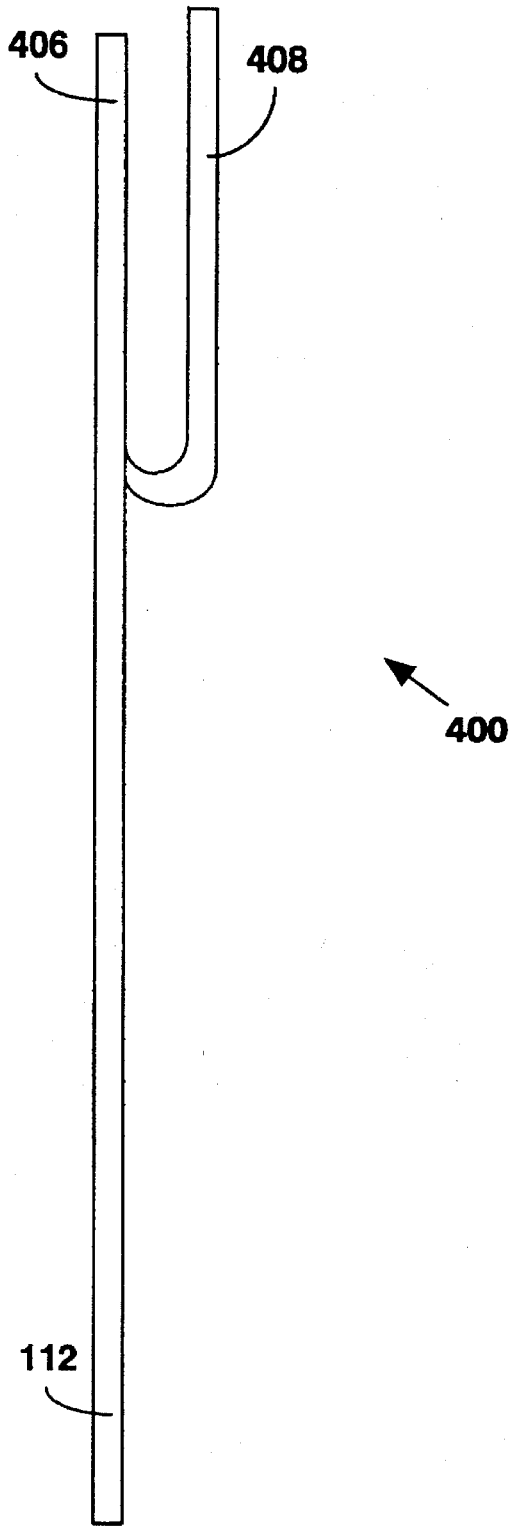

In this embodiment, extension 408 can be folded such that it forms a rounded grip for more comfortable handling by the user. FIGS. 4B and 4C illustrate front and side views, respectively, of the extension 408 in the folded position. As can be seen, by folding extension 408, a rounded surface is formed which provides improved comfort for the user. In addition, the extended central portion 402 also provides more available area for indicia. In the prefered embodiment, the corners of aperture 410 are rounded. By rounding the corners, stress points are eliminated which reduces the possibility of tearing when heavier loads are carried.

Figure 5:
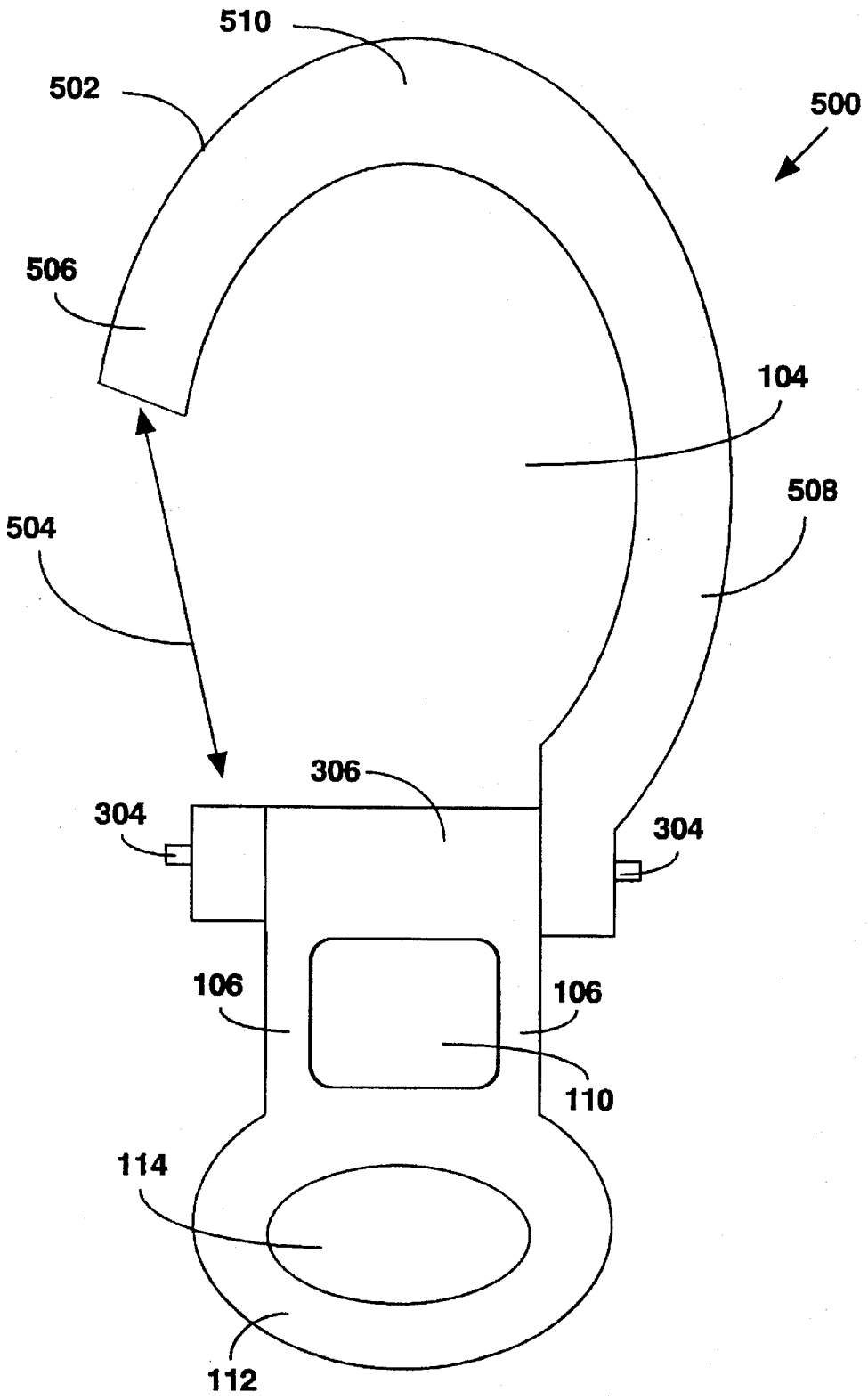
FIG. 5 illustrates an alternative embodiment, similar to the embodiments of FIG. 3, which includes a gap in the handle assembly that allows the handle to be suspended from a closet hanger bar.

FIG. 5 illustrates an alternative embodiment 500 to the device shown in FIG. 3. In this embodiment, handle assembly 502 which includes first arm 506, second arm 508 and central group 510 does not completely encircle aperture 104 as was done in the previous embodiments. A gap 504 is made in handle assembly 502 which allows the handle assembly 502 to be carried and used in the same manner as was done in regard to FIG. 3. The advantage provided by gap 504 is that the garment carrier 500, when taken from the automobile to the users dwelling, can be conveniently hung on a closet clothing bar. Of course, the addition of gap 504 requires that the handle assembly 502 be sufficiently rigid to allow the user to hold garment carrier 500 without having handle assembly 502 deform due to the weight of the garments.

While the invention has been described with respect to a preferred embodiment thereof, it will be understood by those skilled in the art that various changes in detail my be made therein without departing from the spirit, scope, and teaching of the invention. For example, a variety of materials can be used to fabricate the various embodiments. Likewise, the shapes selected for the various components such as the handle assembly, hook attachment, or hanger assembly can vary to suit any number of ornamental objectives. Handle grip styles can also vary to provide more comfortable grips based on the materials used to fabricate the device. Accordingly, the invention herein disclosed is to be limited only as specified in the following claims.

I claim:

1. A portable garment carrier for suspending clothing hangers from a car hook, comprising:

a handle assembly, the handle assembly having a handle assembly aperture;

a central hook attachment having a proximal end and a distal end, the central hook attachment attached at its proximal end to the handle assembly, the central hook attachment having a central aperture of a suitable size to accept a car hook;

a holder assembly attached to the distal end of the central hook attachment, the holder assembly having a holder assembly aperture large enough to accept at least one clothing hanger;

a central grip having a first end, a second end, and a central portion, the central portion further having a flexible extension extending outward from the central portion and capable of folding during use to form a rounded handle grip;

a first arm attached at a first end to the central hook assembly and attached at a second end to the first end of the central grip; and a second arm attached at a first end to the central hook assembly and attached at a second end to the second end of the central grip.

2. A portable garment carrier, as in claim 1, wherein:

the portable garment carrier is comprised of flexible material; and the handle assembly is foldably attached to the central hook attachment such that the handle assembly folds down when the central hook attachment is attached to a car hook.

3. A portable garment carrier, as in claim 1, wherein the handle assembly is attached to the central hook attachment by a hinge.

4. A portable garment carrier, as in claim 2, wherein the handle assembly is attached to the central hook attachment by a hinge.

5. A portable garment carrier, as in claim 3, wherein the handle assembly is rigid.

6. A portable garment carrier, as in claim 1 wherein the central hook attachment further comprises an extended surface area to accommodate indicia.

7. A portable garment carrier for suspending clothing hangers from a car hook, comprising: a central hook attachment;

a substantially rigid handle assembly, further comprising;

a central grip having a first end and a second end;

a first arm, the first arm having a first end and a second end and attached at the first end to the central hook attachment and attached at the second end to the first end of the central grip;

a second arm, the second arm having a first end and a second end and attached at the first end to the central hook attachment and attached at the second end to the second end of the central grip;

the central grip having a connecting portion which attaches at one end to the first arm and at a second end to the second arm, the central grip further having a flexible central portion which folds back during use to form a rounded handle grip; and a gap in the handle assembly such that the central aperture in the handle assembly is not completely encircled by the handle assembly;

the central hook attachment attached to the handle assembly by a hinge, the hook attachment having a central aperture large enough to accept a car hook; and a holder assembly attached to the hook attachment, the holder assembly having a central aperture large enough to accept at least one clothing hanger.

* * * * *